US008844187B2

(12) United States Patent
Pfersmann et al.

(10) Patent No.: US 8,844,187 B2
(45) Date of Patent: Sep. 30, 2014

(54) WEAPON BARREL

(71) Applicant: Diehl BGT Defence GmbH & Co. KG, Ueberlingen (DE)

(72) Inventors: Axel Pfersmann, Feucht (DE); Rainer Himmert, Lauf (DE)

(73) Assignee: Diehl BGT Defence GmbH & Co. KG, Ueberlingen/BRD (DE)

( * ) Notice: Subject to any disclaimer, the term of this patent is extended or adjusted under 35 U.S.C. 154(b) by 0 days.

(21) Appl. No.: 13/962,231

(22) Filed: Aug. 8, 2013

(65) Prior Publication Data

US 2014/0041274 A1 Feb. 13, 2014

(30) Foreign Application Priority Data

Aug. 8, 2012 (DE) ..... 10 2012 015 785

(51) Int. Cl.
*F41C 27/22* (2006.01)
*F41A 21/48* (2006.01)
*F41A 21/26* (2006.01)

(52) U.S. Cl.
CPC ..... *F41A 21/26* (2013.01); *F41A 21/48* (2013.01); *F41C 27/22* (2013.01)
USPC ..... 42/79

(58) Field of Classification Search
CPC ..... F41C 27/22
USPC ..... 42/97, 1.06, 79; 89/198, 14.3
See application file for complete search history.

(56) References Cited

U.S. PATENT DOCUMENTS

| | | | | |
|---|---|---|---|---|
| 3,672,255 | A | 6/1972 | Findlay et al. | |
| 4,211,146 | A * | 7/1980 | Bradley | 89/16 |
| 4,913,031 | A * | 4/1990 | Bossard et al. | 89/14.3 |
| 5,655,632 | A | 8/1997 | Valembois | |
| 6,167,794 | B1 | 1/2001 | Kathe | |
| 6,497,170 | B1 | 12/2002 | Kathe | |
| 8,176,671 | B2 | 5/2012 | Pfersman et al. | |
| 2003/0154851 | A1 | 8/2003 | Ebersole et al. | |
| 2009/0133570 | A1 | 5/2009 | Pfersmann et al. | |

FOREIGN PATENT DOCUMENTS

| | | | |
|---|---|---|---|
| DE | 102007056455 | A1 | 5/2009 |
| FR | 2697881 | A1 | 5/1994 |

* cited by examiner

*Primary Examiner* — Reginald Tillman, Jr.
(74) *Attorney, Agent, or Firm* — Laurence A. Greenberg; Werner H. Stemer; Ralph E. Locher

(57) ABSTRACT

A weapon barrel of an automatic firearm contains a muzzle that is set into flexural oscillations by firing, with a damping device for damping the flexural oscillations by frictional processes between a radially projecting friction ring disposed on the muzzle and at least one friction element loaded by of a spring element. Wherein at least one friction element loaded by a separate spring element acts on both sides of the friction ring respectively and is supported so as to be axially movable relative to the muzzle.

8 Claims, 2 Drawing Sheets

WEAPON BARREL

CROSS-REFERENCE TO RELATED APPLICATION

This application claims the priority, under 35 U.S.C. §119, of German application DE 10 2012 015 785.1, filed Aug. 8, 2012; the prior application is herewith incorporated by reference in its entirety.

BACKGROUND OF THE INVENTION

Field of the Invention

The invention relates to a weapon barrel of an automatic firearm containing a muzzle that is set into flexural oscillations when firing, with a damping device for damping the flexural oscillations by frictional processes between a radially projecting friction ring disposed on the muzzle and at least one friction element loaded by a spring element.

With conventional automatic weapons, in continuous firing operation the hit precision is influenced to a considerable extent by the flexural barrel oscillations, which lead to an unwanted scattering in the firing pattern. In order to counter this, the attempt to increase the stiffness of the weapon barrel would be made, e.g. by increasing the wall thickness of the muzzle, which however has a disadvantageous effect on the weight. Moreover, this measure also only gives a small improvement in the hit pattern, because only the amplitudes of the barrel flexural oscillations would be reduced, but the oscillations cannot be inhibited.

A weapon barrel of the above-mentioned type is known from published, non-prosecuted German patent application DE 10 2007 056 455 A1 (corresponding to U.S. Pat. No. 8,176,671), which contains a damping device that enables the flexural barrel oscillations caused by firing to be damped as completely as possible in each case between the individual shots of a volley. The underlying idea is that if the muzzle is returned to its rest position following the decay of the flexural barrel oscillations prior to each shot, the exit direction of all shots is at least substantially identical, which ultimately leads to very closely adjacent impact points and thus to an optimized firing pattern.

The damping device known from this uses frictional processes for this purpose between a radially projecting friction ring disposed on the muzzle and a spring-loaded friction element that is positionally fixed relative thereto. The kinetic energy of the flexural oscillations is at least substantially dissipated by frictional processes that are triggered by the flexural oscillations between each two successive shots in the firing sequence. The kinetic energy, i.e. the vibration energy of the muzzle, is converted into thermal energy, as a result of which energy is extracted from the oscillating system and the muzzle oscillation is caused to decay prior to each shot. This enables significant settling of the system, finally resulting in an optimized firing pattern being achieved.

The damping device known from published, non-prosecuted German patent application DE 10 2007 056 455 A1 contains besides the muzzle, on which the radially projecting friction ring is disposed in a fixed position, a housing as another part of the damping device, through which the muzzle is passed and in which the friction ring of the muzzle is located. The housing is fixed in position and the muzzle is fed through the housing with play. In the housing the spring element, e.g. a coil spring, is supported on one side and the other end of the coil spring presses against a friction element, which is likewise implemented as a friction ring and which is axially movable within the housing, so that it can be sprung against the friction ring on the muzzle side. When viewed in the radial direction, the friction element is also fixed in position in relation to the flexural oscillations of the muzzle, so that for any oscillatory movement of the muzzle the friction ring on the muzzle side moves relative to the friction element fixed on the housing side and frictional processes occur.

Although the damping system known therefrom provides outstanding damping of the oscillations, its effectiveness is subjected to changes with increasing firing power. This is because when firing with such an automatic weapon considerable temperature rises of the muzzle of up to a few 100° can occur, i.e. the muzzle heats up increasingly with increasing number of shots. The muzzle lengthens (in this application "muzzle" is basically understood to mean any barrel that is used to fire a round or projectile). This inevitably leads to an axial displacement of the friction ring on the muzzle side relative to the fixed housing of the damping device and thus to a change of the bias on the friction element on the housing side by the spring element on the housing side, which is compressed or expanded slightly for a temperature-dependent axial movement of the friction ring on the muzzle side, depending on whether the spring element, when viewed axially, is disposed behind or in front of the friction ring on the muzzle side. This ultimately results in a change of the preload on the friction element on the housing side, i.e. the force with which this is pressed against the friction ring on the muzzle side, which results in the frictional conditions changing depending on the temperature. This leads in turn to a change of the damping characteristic of the system.

SUMMARY OF THE INVENTION

The invention is thus based on the problem of specifying a barrel of a weapon with a damping device that offers the possibility of temperature compensation.

In order to solve the problem, it is provided for a weapon barrel of the type mentioned above in accordance with a first solution according to the invention that at least one friction element, which is mounted so as to be axially movable relative to the muzzle and is loaded by a separate spring element, acts on both sides of the friction ring.

With this solution of the invention the friction ring on the muzzle side is clamped on both sides by at least one separate spring-loaded friction element in each case. Each friction element is, however, axially movable, i.e. when viewed axially its position relative to the muzzle can change. However, the respective spring elements, i.e. coil springs for example, remain with their free ends not in contact with the friction element in their supporting position.

If a temperature-related lengthening now occurs, then the friction ring on the muzzle side moves axially, which results in the at least one friction element, which is disposed after it when looking axially, likewise moving axially by the same distance when viewed axially. Wherein the spring element acting on the friction element is simultaneously compressed somewhat more strongly. On the other side the opposing spring element that tensions the second friction element lengthens somewhat, after the at least one friction element acting on the friction ring on the muzzle side moves axially somewhat as a result of the axial movement of the friction ring on the muzzle side. In effect there is also an increase in the preload on the one side as a result of the compression of the spring element there and a reduction in the preload on the other side as a result of the lengthening of the spring element there. In total the bias and thus the force with which both friction elements tension the muzzle side friction ring or press on it remain the same. This of course assumes that spring elements with substantially identical spring characteristics are used.

Since substantially the same friction conditions are always produced by the temperature compensation independently of where specifically the friction ring on the muzzle side is positioned relative to the friction elements, as a result uniform flexural oscillation compensation is also achieved over a very large temperature range.

Advantageously, two or more pairs of oppositely disposed friction elements are provided distributed equidistantly about the circumference of the muzzle. For example, two, three or four such friction elements can be provided on each side of the friction ring, each loaded by a separate spring element. The effective friction surface and hence the damping characteristic can be adjusted by the number of friction elements used and their size.

The friction elements can, according to a first embodiment of the invention, be implemented as friction pins, each of which is axially movably accommodated in a mounting. Such a friction pin contains e.g. an oblong pin body, by which the friction pin is accommodated in the mounting and is axially guided. A friction head of increased diameter is disposed on the pin body and is in contact with the friction ring of the muzzle.

As an alternative to the use of such one-piece friction pins it is conceivable to implement the friction elements as friction plates disposed axially movably on respective pins, each of which for its part is attached to a mounting in a fixed manner. Consequently, such a pin is thus only used as an axial linear guide for the friction plates that are axially movable thereon, which are spring loaded. The friction plates are dimensioned in their thickness and the pins are dimensioned in their length such that even for a maximum muzzle length there is no impact of the friction ring on the muzzle side on the end of the pin.

Besides individual friction plates, which are each individually guided on such a pin, it is also conceivable to position on each side only one large friction plate through which the muzzle is passed, each of which is axially movably supported on a plurality of pins, wherein the pins for their part are attached to a mounting in a fixed manner. Thus on each side not only a local friction plate or numerous local friction plates are used here, but in each case only one circumferential friction plate through which the muzzle is passed, resulting in a much larger friction surface.

Irrespective of whether one-piece axially movable friction pins are provided, or pins that are axially fixed but which support axially movable friction plates, the friction pins or the pins are always accommodated in a suitable mounting. The mountings are, according to an advantageous development, implemented as mounting rings at a fixed distance from each other, through which the muzzle is passed. It is particularly advantageous if the mounting, especially the two mounting rings, is disposed on a muzzle casing enclosing the muzzle. Such a muzzle casing is a hollow, essentially cylindrical component that encloses the muzzle with a separation distance, so that there is sufficient space to integrate the mounting, e.g. in the form of the two mounting rings.

For technical assembly reasons it is advantageous if the mounting is implemented as a sleeve, which contains on both ends respectively a radially inwardly facing flange, wherein each flange forms a mounting ring. The sleeve, for technical assembly reasons preferably naturally in two parts so that during assembly the friction ring can be mounted on the muzzle side, can be positioned on the inner side of the muzzle casing in a simple manner.

As already described above, the first solution according to the invention is characterized in that at least one friction element that is loaded by a separate spring element acts respectively on both sides of the friction ring, which is movable axially relative to the muzzle. The friction ring is thus clamped on both sides. An alternative embodiment of the invention that equally solves the above-mentioned problem provides for a weapon barrel of the above-mentioned type that the damping device contains a housing in which the at least one friction element is accommodated with the spring element and in which the friction ring engages radially, wherein the housing is axially movable relative to the muzzle with the friction element and spring element but is radially fixed.

With the embodiment of the invention, with which only on one side of the friction ring acts on at least one spring-loaded friction element, the damping device is, in the case of a thermally induced muzzle extension, also moved when viewed quasi axially, i.e., it moves axially with the muzzle, for which purpose according to the invention the housing with the integrated friction element and spring element is mounted so as to move relative to the muzzle or with the muzzle. The housing with the friction element and spring element is, however, radially fixed. In other words, the housing and thus the damping device do carry out the axial movement with the muzzle, but no radial movement, that is do not oscillate with it. This likewise always results in the same damping-related frictional characteristics, irrespective of the specific actual length of the muzzle, because nothing changes within the damping system as a result of the comovement. Thus the damping system is, when viewed axially, almost always driven to move and remains unchanged.

Here too a plurality of friction elements together with spring elements, here too normally coil springs, can be accommodated in the housing and distributed equidistantly about the circumference of the muzzle.

As described, the housing together with its contents is mounted so as to be axially movable, so that a comovement of the housing by the friction ring is possible in the case of muzzle lengthening. In order to achieve simple axial guidance, an advantageous development of the invention provides that the friction element or elements is/are implemented as a friction pin or as friction pins, which protrude(s) out of the housing and is/are mounted axially movably in a mounting that is fixed in position when viewed axially and clearly does not also carry out the flexural oscillations. Thus friction pins are likewise used here, containing a pin body on which a friction head of increasing diameter is disposed. At the same time, however, the pin body has the function of acting as an axial bearing or as an axial guide, for which purpose it is implemented with suitable length and is led out of the housing of the damping device and engages in a positionally fixed mounting serving as the axial bearing or the axial guide. There it passes through e.g. a suitable bearing bore or similar, in which it is accommodated so as to be axially movable but radially fixed. If the housing now moves as a result of a muzzle extension, then the friction pin or pins is or are pulled out of the mounting by a suitable amount, and in the case of cooling is or are pushed back again, by which the axial guidance or axial mobility is implemented in a very simple manner.

Here too the mounting can advantageously be implemented as a mounting ring, which is disposed in a muzzle casing enclosing the muzzle and preferably closes the muzzle casing at the end. The mounting ring is penetrated by the muzzle with adequate separation so that even under strong flexural oscillations there is no impact of the muzzle on the mounting ring.

As mentioned, with the second alternative embodiment of the invention the friction ring of the muzzle contacts at least one spring-loaded friction element on only one side. On the other side the friction ring can alternatively be directly supported on the housing side. It is advantageous, however, if one or more other friction plates are directly attached in the housing, preferably to the housing itself, which act on the other side of the friction ring opposite the friction ring. Here too there is thus a defined friction on both sides between the friction ring and the corresponding friction components on both sides.

The friction ring and the friction element or elements, possibly also the friction plates, are advantageously made of steel, especially of stainless steel, i.e. so that there is a steel-steel friction pair. The mounting, especially the mounting rings or the housing, can either be made of aluminum or steel, especially stainless steel.

Other features which are considered as characteristic for the invention are set forth in the appended claims.

Although the invention is illustrated and described herein as embodied in a weapon barrel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
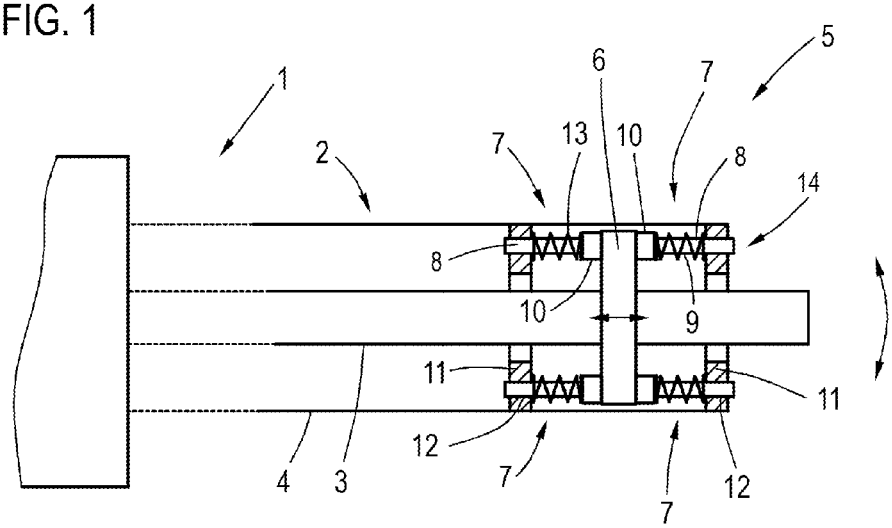
FIG. 1 is a diagrammatic, sectional view of an automatic firearm containing a barrel of a weapon according to the invention in a first embodiment.

Referring now to the figures of the drawing in detail and first, particularly, to FIG. 1 thereof, there is shown an automatic firearm 1 having a weapon barrel 2 according to the invention with a muzzle 3, which is accommodated in a muzzle casing 4, which lies at a distance from the muzzle 3. During firing flexural oscillations of the muzzle 3 occur, as indicated by the double arrow on an end of the muzzle 3. In order to damp or compensate oscillations a damping device 5 is provided, which carries out damping of the flexural oscillations by generated frictional processes, but at the same time is also able to provide uniform damping characteristics at any point in time, since any thermally induced geometric effects that take the form of a lengthening of the muzzle 3 can be compensated.

For this purpose, on the one hand a friction ring 6 is provided on the damping device 5, being mounted on and able to move radially with the muzzle 3, but being axially fixed and being acted upon both sides by radially fixed friction elements 7. In the example shown in total four friction elements 7 are shown, wherein two are provided above and two below the muzzle 3. Obviously four such friction elements can also be provided e.g. on each side, in this case distributed equidistantly about the circumference of the muzzle. Each friction element 7 is in the form of a one-piece friction pin 8, which on the one hand contains the oblong pin body 9, and on the other hand contains a widened friction head 10, which acts respectively on the friction ring 6 or its friction surface. Each friction pin 8 is axially movably accommodated in a mounting 14, which is implemented as a mounting ring 11 in each case. For this purpose corresponding through apertures 12 are provided in each mounting ring 11, through each of which the pin body 9 engages. The pin body 9 and hence the friction pin 8 is guided in the through aperture 12 so as to be axially movable but radially fixed.

Furthermore, each friction pin 8 is biased towards the friction ring 6 by a spring element 13, here a coil spring in each case. For this purpose the respective coil spring is supported on the one hand on the respective mounting ring 11 and on the other hand on the friction head 10.

As FIG. 1 shows, at least two such friction elements 7 in the form of the friction pins 8 are provided on both sides of the friction ring 6 respectively, each of which is axially guided in the mounting rings 11 and is biased by the spring element 13 in each case. The mounting rings 11 are disposed in an axially fixed manner on the muzzle casing 4, which can be made of metal or even of a composite material, so that consequently they do not move axially in the event of a thermal lengthening of the muzzle 3.

If such a thermal lengthening occurs owing to firing, then depending on the lengthening the friction ring 6 moves somewhat to the right starting from the example shown in FIG. 1. The result is that both friction pins 8 disposed to the right of the friction ring 6 are forced to the right, which is possible because they are axially movably accommodated in the bores or through apertures 12. At the same time the associated spring elements 13 are compressed more strongly, i.e., so that the preload there increases. There is an inverse effect on the other side of the friction ring 6. The friction pins 8 preloaded by the spring elements 13 likewise move to the right because as described they are also axially movably guided in the respective bores or through apertures 12, wherein the axial movement is caused by relaxation of the spring elements 13 there. In other words, on one side the spring elements 13 are compressed as a result of the muzzle lengthening and on the other side they are relaxed. In total the bias force of the friction elements 7 on the friction ring 6 remains the same, however, so that the total friction of the damping system does not change despite a thermally induced muzzle lengthening. In the event of cooling of the muzzle an opposite movement occurs, there is a reverse movement of the friction pins 8 to the left, connected in turn with a compression of the spring elements 13 located on the left and relaxation of the previously compressed spring elements 13 located on the right.

In order to provide constant friction conditions over a suitable temperature range and hence a suitable range of longitudinal movement, the spring elements 13 used are identical, i.e. they all have identical spring characteristics, so that altogether they produce a frictional force that is uniform independently of the heat of the muzzle.

Figure 2:
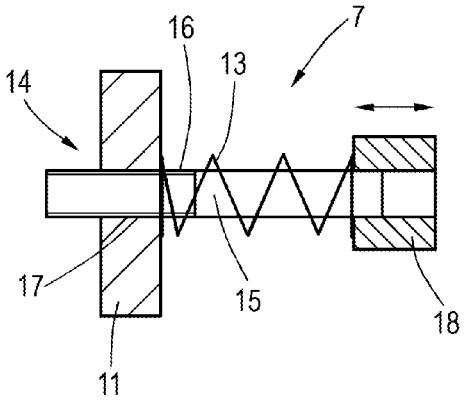
FIG. 2 is an illustration of a second embodiment of friction elements that can be used.

Whereas for the example embodiment according to FIG. 1 one-piece friction pins 8 are used in each case, there is also the option to configure the friction elements differently. An example of this is shown in FIG. 2, wherein here only one friction element 7 is shown, whereas of course a plurality of such friction elements can be provided in the barrel of a weapon itself. The friction element 7 contains a pin 15, which is screwed using a threaded section 16 into a threaded bore 17 of a mounting ring 11. It would of course also be conceivable to weld the pin onto the mounting ring 11 or similar. A friction plate 18 is mounted on the pin 15 and is consequently axially movably guided on the pin 15. It is also spring-loaded by the spring element 13, again a spiral spring. In the event of an axial movement of the muzzle 3 and hence of the friction ring 6, here there is only a movement of the friction plate 18. It is either pushed upwards further onto the pin 15 (i.e. if the friction element starting from FIG. 1 is positioned to the right of the friction ring 6), connected with compression of the spring element 13, or the friction plate 18 is pushed down further from the pin 15 by the expanding spring element 13 (which would be the case for friction elements disposed to the left of the friction ring 6), related respectively to the case that the friction ring 6 is moved to the right by a thermal effect.

Figure 3:
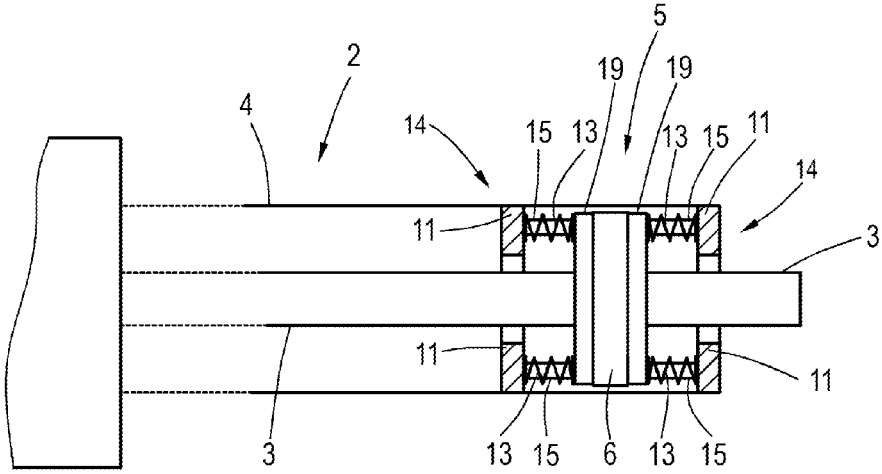
FIG. 3 is a diagrammatic, sectional view of another alternative embodiment according to the invention of the barrel of the weapon according to the invention similar to the one from FIG. 1.

A third configuration of the damping device 5 comparable with the embodiment according to FIG. 1 is shown in FIG. 3. The configuration is thus similar to the one from FIG. 2. There too suitable pins 15 are attached to both the mounting rings 11, i.e. either screwed on or welded. Instead of a respective single friction plate 18 on each pin 15, here a common axially movable friction plate 19 mounted on all pins 15 of one side is provided, through which the muzzle 3 passes. The arrangement is identical on both sides of the friction ring 6. In this case there is thus a very large friction surface between the large friction plate 19 and the friction ring 6. In the case of muzzle lengthening in this case, the respective friction plate 19 is alternatively pushed further onto the common pins 15 and the spring element 13, which of course is also provided here, is compressed, which holds true in relation to FIG. 3 for a muzzle lengthening to the right for the damping element positioned to the right of the friction ring 6. On the other side, the friction plate 19 is driven back by the expanding spring element 13 as a result of the frictional movement. In turn there is a change in the preload on the spring element relative to the respective side of the friction ring, in total however the friction conditions or the acting frictional force remain(s) the same.

Figure 4:
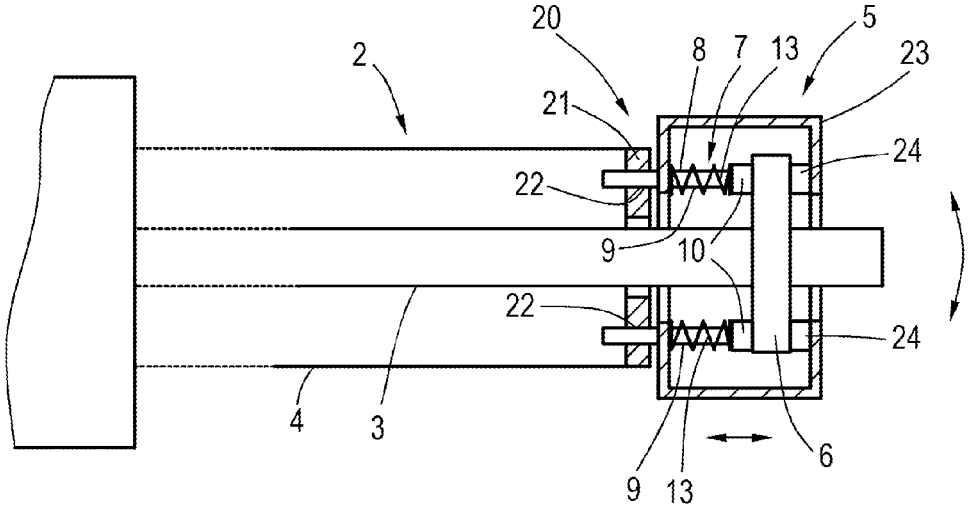
FIG. 4 is a diagrammatic, sectional view of a fourth embodiment according to the invention of the weapon barrel with an axially movable damping device.

FIG. 4 shows a second inventive configuration of the damping device 5 based on an alternative principle as part of the weapon barrel 2. The muzzle 3 and the muzzle casing 4 enclosing the muzzle 3 are again provided. On the muzzle casing 4 a mounting 20 is provided at the end, here too in the form of a mounting ring 21, having a plurality of through apertures 22, in which ends of the friction elements 7 engage, here too implemented in the form of one-piece friction pins 8. The pin body 9 of each friction pin 8, which also connects to the friction head 10 in this case, is thus made so long that it engages in the through apertures 22 in the mounting ring 21. There each pin body 9 is axially movably guided, but is radially fixed.

The damping device 5 further contains a housing 23, in which the friction pins 7 are accommodated and from which the pin bodies 9 emerge at the end and are led into the through apertures 22. The friction ring 6 of the muzzle 3 also engages in the housing 23. In the initial position, with one side it contacts friction plates 24 provided on the housing 23, a first friction plane thus being formed here. Friction heads 10 of the friction pins 8 act on the other side of the friction ring 6, wherein the friction pins 8 in turn are preloaded by spring elements 13, here too coil springs, which are supported on one side on the housing 23 and on the other side on the friction head 10. The housing 23 itself is not connected to the mounting ring 21 on the muzzle casing 4.

If there is a thermally induced lengthening of the muzzle 3, then the friction ring 6 also moves to the right starting from FIG. 4 in this case. However, the damping device 5, i.e. the housing 23 together with the friction elements 7, the spring elements 13 and the friction plates 24, is thereby taken along, i.e. so that the entire damping device 5 carries out the same axial movement. The friction pins 8 or the pin body 9 are pulled out somewhat from the mounting ring 21 when viewed axially, corresponding to the lengthening of the muzzle 3, wherein it is obviously ensured that they are not completely pulled out here. I.e. it is ensured that the damping device 5 follows any axial movement of the muzzle 3 or of the friction ring 6, i.e. it is moved along therewith. Because the spring elements 13 are disposed within the housing 23 that is taken along therewith and also because the friction pins 8 and the friction ring 6 are taken along, consequently nothing changes in the entire geometry within the damping device 5, so that the same friction conditions always occur independently of the specific axial position of the friction ring 6 or of the damping device 5.

The central difference between the basic versions according to FIGS. 1 and 4 thus consists in the fact that within the version according to FIG. 1 only the friction ring 6 and the friction elements 7 acting upon it are axially moved, whereas according to the version in accordance with FIG. 4 the entire damping device as such is moved axially.

Figure 5:
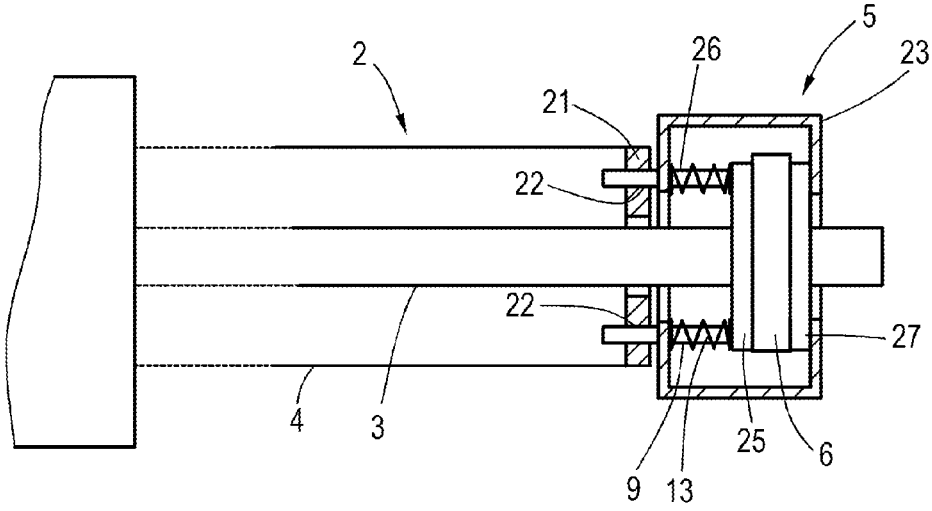
FIG. 5 is a diagrammatic, sectional view of a fifth alternative embodiment of the weapon barrel, likewise with an axially movable damping device.

Finally, FIG. 5 shows a configuration of the damping device 5 similar to that of FIG. 4, wherein the configuration is the same for this reason. Whereas in FIG. 4 two separate friction pins 8 are used, here a common friction plate 25 is provided, through which the muzzle 3 is passed and on which axially protruding pins 26 are provided, which are led out of the housing 23 and engage in corresponding through apertures 22 of the mounting ring 21 also provided here, which is attached to the end of the muzzle casing 4. Comparable with the embodiment according to FIG. 3, in this case a significantly larger friction surface is also provided on this side. Correspondingly, on the other side of the friction ring 6, instead of the plurality of further friction plates 24 a friction plate 27 is provided, through which the muzzle 3 is likewise passed and that provides a comparable friction surface to the friction plate 25. The operation, however, is overall the same as described in relation to FIG. 4.

The invention claimed is:

1. A weapon barrel of an automatic firearm, the weapon barrel comprising:

a muzzle being set into flexural oscillations during firing; and a damping device having a plurality of frictional elements, a plurality of separate spring elements and a radially projecting friction ring, said damping device damping the flexural oscillations by frictional processes between said radially projecting friction ring disposed on said muzzle and said plurality of frictional elements loaded by means of said separate spring elements, said one plurality of frictional elements loaded by means of said separate spring elements acting upon both sides of said radially projecting friction ring respectively and said plurality of frictional elements are supported so as to be axially movable relative to said muzzle in each case.

2. The weapon barrel according to claim 1, wherein said plurality of frictional elements contain at least two pairs of oppositely disposed friction elements that are distributed equidistantly about a circumference of said muzzle.

3. The weapon barrel according to claim 1, further comprising a mounting supported by said muzzle, wherein said plurality of frictional elements are friction pins, each of said friction pins is accommodated in said mounting so as to be axially movable.

4. The weapon barrel according to claim 1, further comprising:

a mounting supported by said muzzle; and pins, wherein said plurality of frictional elements being friction plates that are each disposed so as to be axially movable on said pins, said pins being attached to said mounting.

5. The weapon barrel according to claim 3, wherein said mounting is one of a plurality of mountings in a form of mounting rings with a fixed distance between said mountings through which said muzzle is passed.

6. The weapon barrel according to claim 3, further comprising a muzzle casing enclosing said muzzle, said mounting has two mounting rings disposed on said muzzle casing enclosing said muzzle.

7. The weapon barrel according to claim 3, wherein said mounting is a sleeve, having ends each with a radially inwardly facing flange, wherein each said radially inwardly facing flange forms a mounting ring.

8. The weapon barrel according to claim 1, further comprising:

a mounting supported by said muzzle; and pins, wherein said plurality of frictional elements being friction plates through which said muzzle is passed, each being supported on said plurality of pins so as to be axially movable, said pins being attached to said mounting.

* * * * *